United States Patent [19]

Strub et al.

[11] 4,387,553

[45] Jun. 14, 1983

[54] BANDING APPARATUS

[76] Inventors: Eric W. Strub; Kenneth M. Strub, both of 235 Rockhill Rd., Vista, Calif. 92083

[21] Appl. No.: 222,004

[22] Filed: Jan. 2, 1981

[51] Int. Cl.[3] ..... B65B 5/00

[52] U.S. Cl. ..... 53/585; 53/291; 53/295

[58] Field of Search ..... 53/295, 291, 585, 582

[56] References Cited

U.S. PATENT DOCUMENTS

| | | | |
|---|---|---|---|
| 2,033,238 | 3/1936 | Geyer et al. | 53/291 X |
| 2,068,107 | 1/1937 | Nygard | 53/291 |
| 2,652,963 | 9/1953 | Pomeroy | 53/295 X |
| 2,815,628 | 12/1957 | Eddison et al. | 53/291 |
| 2,835,088 | 5/1958 | Eddison et al. | 53/291 X |
| 2,858,660 | 11/1958 | Browne et al. | 53/291 |

*Primary Examiner*—Horace M. Culver

*Attorney, Agent, or Firm*—Brown & Martin

[57] ABSTRACT

A banding apparatus for automatically selecting successive bands from a source of bands and placing them on individual containers on an adjacent conveyor includes a finger gripping apparatus having a plurality of fingers moveable radially inwardly for insertion into the band and moveable radially outwardly for expanding into gripping engagement with the band and includes a chain drive for the gripping apparatus to a position for placing the band on the container carried on an adjacent conveyer.

12 Claims, 8 Drawing Figures

BANDING APPARATUS

BACKGROUND OF THE INVENTION

The present invention relates to banding apparatus and pertains particularly to an apparatus for selecting and placing bands on articles or containers.

The banding of container tops and caps with heat shrinkable bands for sealing purposes has been known for quite some time. Suitable machines for carrying out this function have been known for some time and a suitable machine is disclosed and claimed in our U.S. Pat. No. 3,802,152, issued Apr. 9, 1974, and entitled "Banding Apparatus". Such machines are quite effective for the cutting and placing of bands around articles and container tops for most applications.

Heat shrinkable bands are also currently used for attachment of information packets and the like to bottles and other containers.

Current interest in the banding and sealing of large mouth food containers has created a need for more effective apparatus for handling bands of a large diameter to length ratio. The prior art machines and apparatus currently available are satisfactory and highly efficient for banding of small containers wherein the diameter of the container compared to the length of the band is not great.

A problem arises wherein the length of the band becomes quite short when compared to the diameter of the band. The presently known machines frequently become jammed because the band will not maintain its proper orientation within the machine or in passing from the machine onto the container.

It is apparent that more effective handling apparatus is required for handling such bands for large mouth containers and for the banding of such large articles.

SUMMARY AND OBJECTS OF THE INVENTION

It is the primary object of the present invention to provide an improved banding machine.

In accordance with the primary aspect of the present invention a banding apparatus includes a gripping device including expandable fingers for selectively engaging bands from a source and placing them on or around an article.

BRIEF DESCRIPTION OF THE DRAWINGS

The above and other objects and advantages of the invention will become apparent from the following description when read in conjunction with the drawings wherein.

DETAILED DESCRIPTION OF A PREFERRED EMBODIMENT

Figure 1:
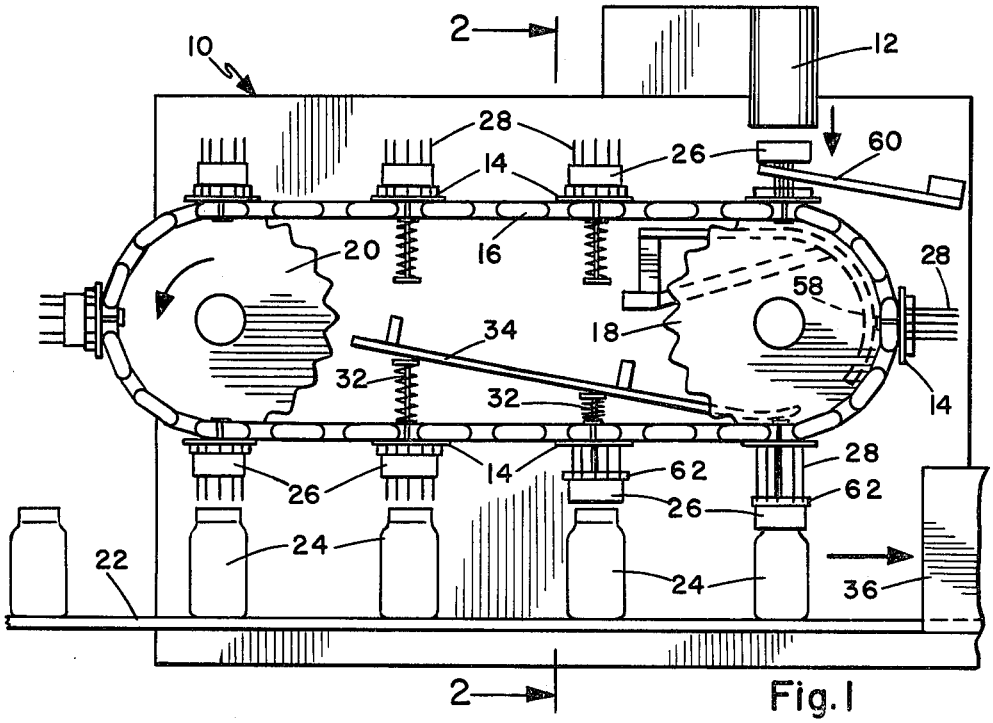
FIG. 1 is a side elevation view of the complete banding apparatus.

Turning now to the drawings, particularly FIG. 1, an apparatus in accordance with the invention is illustrated and designated generally by the numeral 10. The apparatus includes a source of bands such as an apparatus 12 for selectively feeding a tube of banding materials from roll and selectively cutting bands of a predetermined length from the supply roll of band material. Such an apparatus is shown in my aforementioned patent which is incorporated herein by reference.

Apparatus for selecting a band and placing it on an article includes a plurality of band gripping devices 14 mounted on a pair of spaced apart parallel endless chains 16 mounted on spaced apart paired sprockets 18 and 20 and driven such that the plurality of grippers 14 move in an endless path parallel to a conveyor belt or the like 22 containing a plurality of containers or articles 24 on which bands 26 are to be placed. The gripper devices 14 on the endless chains 16 each move into position as a band 26 is cut and opened and the gripper device includes a plurality of outwardly extending fingers 28 that insert in the band and expand radially outward for gripping the band 26 and carrying it along the path into a position over the article or container 24. The conveyor 22 then carries the article to a heat chamber or furnace 36 for shrinking the band in place on the article or container. The band is typically placed around the neck of bottles and overlap the joint between the cap and neck of the bottle to seal the bottle closed.

The banding material is supplied as a thin walled flat tube from a roll of tubular material. The material is fed into a cutting device as in my aforementioned patent and cut to appropriate lengths. The band is then opened to receive the fingers 28 of the gripping apparatus. A preferred apparatus for opening the bands 26 include a vacuum gripper (not shown) for gripping one side of the band and a movable vacuum gripper (not shown) for gripping the other side of the band and a movable vacuum gripper gripping the other side of the band and moving outward to pull the one side of the band away from the other to permit the fingers of the gripper means to extend inside the band. The band 26 is released and drops down over and is engaged by the fingers 28 with the fingers simultaneously gripping the band and forcing it outward into its appropriate shape to encircle an article or container. Preferably the fingers extend partially into the band before it is released to fall onto the fingers. The fingers are cammed inward to their innermost position preparatory to receiving a band, as seen in FIG. 1.

It will be appreciated from the following description that the apparatus can handle bands of varying size within the limits of its expansion and contraction without modification. The expansion of the fingers within these limits is confined to or determined by the diameter of the band. Thus, the apparatus can selectively select bands of any diameter or circumference sufficiently large to be engaged or inserted over the ends of the fingers when the fingers are in their innermost position close to the center axis of the gripper apparatus. The outermost or maximum diameter of a band is determined by the maximum expansion or diameter of engagement of the fingers. Thus, the range in size of the band is determined respectively by the minimum size and the maximum size that can encircle the fingers in their contracted position or their maximum expanded position.

Figure 3:
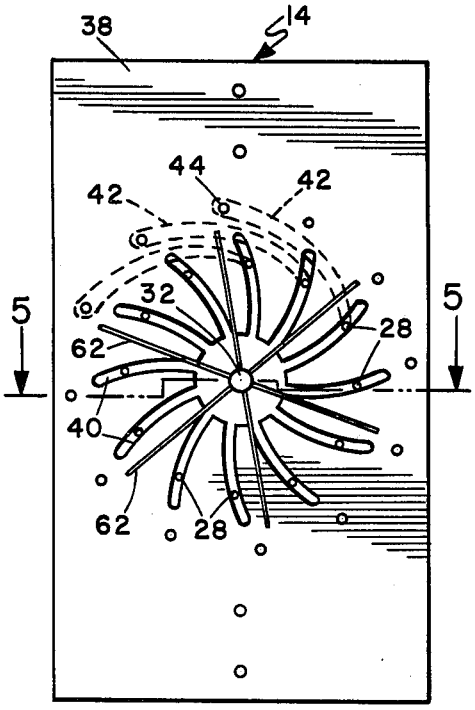
FIG. 3 is an underside view of one band carrying unit.

The gripping units 14 (FIG. 3) each comprise a base plate 38 having a plurality of radially extending slots 40 in which the fingers 28 move radially inward and outward. The fingers 28 are each mounted on an arm 42 that is pivotally mounted on a pin 44 that permits the finger 28 on the outer end thereof to swing along the arcuate slot 40.

A plurality of fingers are appropriately mounted on arms and move in the spiral grooves to inner and outer positions. Follower pins 45 on arms 42 are engaged by a plurality of arcuate cam grooves 46 in a rotating plate 48 which rotates and cams the fingers outward to the outermost position. The rotating cam plate 48 is mounted on a rotatable shaft 50 mounted in bores in plate 38 and 52 and includes an arm 54 having a follower 56 on the end thereof for engaging a stationary cam 58 (FIG. 2) adjacent the track or chain carriage. The relative position and instruction of the parts is best illustrated in FIGS. 7 and 8.

Figure 4:
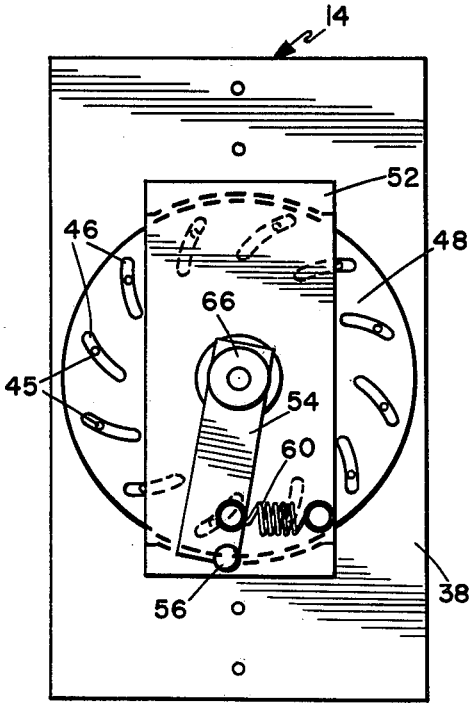
FIG. 4 is a top plan view of the band carrying unit.
Figure 7:
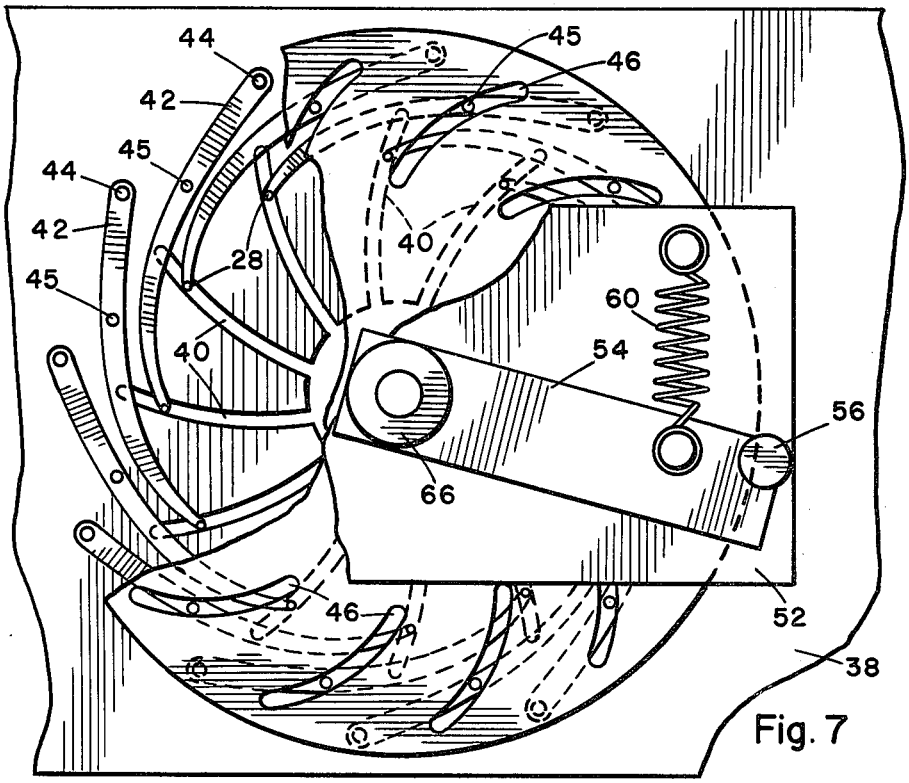
FIG. 7 is an enlarged top plan view of the band carrying unit, with portions cut away to show the band holding mechanism in expanded position.

A preferred form of the apparatus, the fingers are cammed to their outermost position and maintained in that position by a spring 60 acting continuously on the arm 54 biasing cam plate 48 to a position maintaining the fingers 28 in the outermost position (FIGS. 4 and 7). This predetermined bias maintains the fingers in the outermost position until cammed inward by suitable cam means 58 engaged by the cam follower 56 on the arm 54 as it moves along with the endless chain or carriage assembly.

Figure 2:
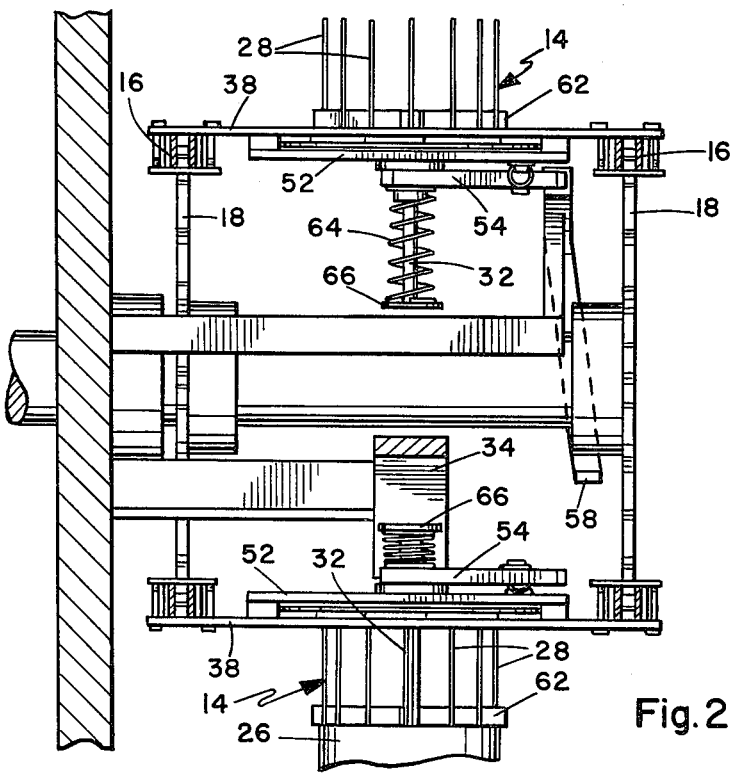
FIG. 2 is an enlarged sectional view taken on line 2—2 of FIG. 1.
Figure 8:
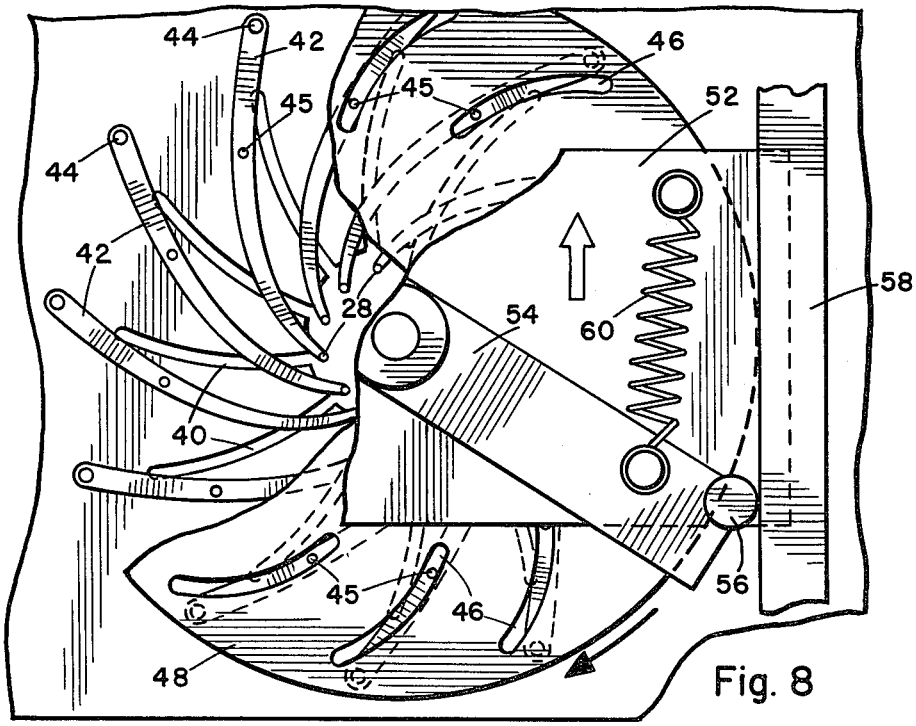
FIG. 8 is a view similar to FIG. 7, but with the band holding mechanism in the contracted position.

The stationary cam 58 is positioned adjacent and extends along adjacent the chain 16 on sprocket 18 for engagement with the arm 54 and acts to rotate the arm and cam plate 48 for camming the fingers to their innermost position in preparation for receiving a band as shown in FIGS. 1 and 8. As soon as the arm 54 and follower 56 pass of the end of cam 58 the spring acts to pull arm 54 to a position to cam fingers 28 outward to the outermost position (FIG. 2).

A V-cam 60 is positioned adjacent and in front of the band source to insure that the fingers 28 are forced inward to receive a band. This cam 60 is not essential to the operation of the machine but is merely a back-up to insure that the fingers are forced together in case some of them become bent outwardly for example.

Figure 5:
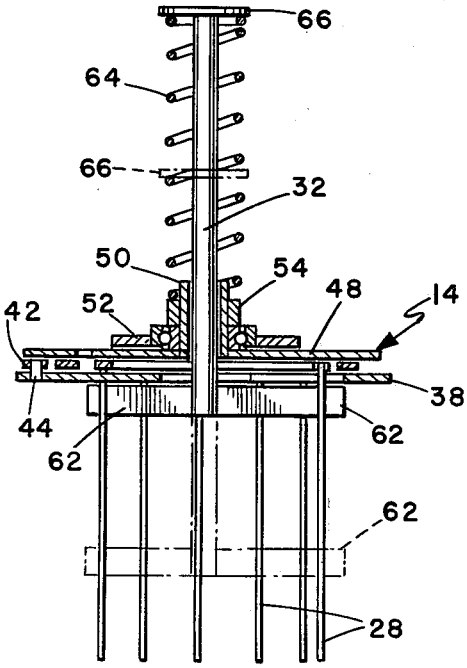
FIG. 5 is a sectional view taken on line 5—5 of FIG. 3.
Figure 6:
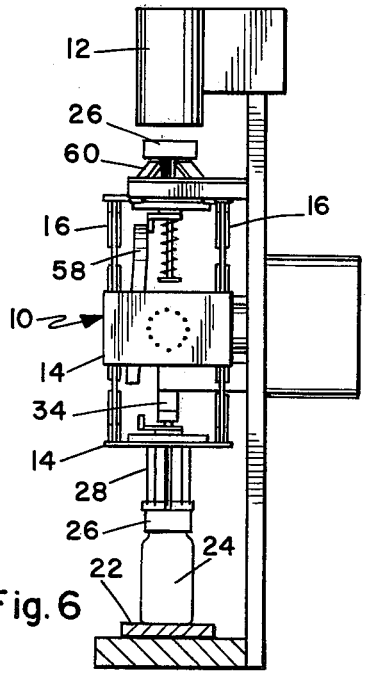
FIG. 6 is an end view as taken from the right hand end of FIG. 1.

The plunger 32 includes an elongated shaft reciprocably mounted in a bore in shaft 50 and projects through to the finger side of the gripper device (FIG. 5) and includes a plurality of radially extending fingers 62. These fingers extend radially outward from the end of the shaft beyond the fingers and are adapted to engage and force a band off the fingers. A compression spring 64 extends between a cap 66 and arm 54 to bias the plunger to the retracted position. The cap end of the plunger engages ramp cam 34 and is biased downward (FIGS. 1 and 5) for forcing bands 26 off finger 28 onto bottles 24.

Having described our invention we now claim:

1. A banding apparatus comprising:

a source of endless bands, gripping means comprising a base member having a central axis, a plurality of fingers mounted about and extending generally parallel to said axis and movable radially inward toward said axis and radially outward from said central axis for simultaneously gripping and expanding a band to encircle an article, first means for moving said fingers radially inwardly toward said axis for receiving a band, second means for moving said fingers radially outwardly for gripping said band, and transport means for transporting said gripping means from a position at said source of endless bands to a position of encircling an article with said band.

2. The banding apparatus of claim 1 wherein said first means for moving said fingers comprises cam means.

3. The banding apparatus of claim 2 wherein said cam means comprises a rotatable cam rotatable about said central axis for camming said fingers toward said axis, and a fixed cam for actuating said rotatable cam.

4. The banding apparatus of claim 3 including a plurality of said gripping means mounted on and carried by an endless chain, conveyor means adjacent said chain for conveying articles to a position for receiving a band so that said gripping means pick up bands from said source and places said bands on articles on said conveyor.

5. The banding apparatus of claim 4 wherein said endless chain is disposed above said conveyor, and articles on said conveyor are bottles.

6. The banding apparatus of claim 4 including band ejecting means for forcing bands from said fingers onto said articles.

7. The banding apparatus of claim 6 wherein said band ejecting means comprises a plunger extending along said central axis and having means for engaging a band on said fingers, and cam means for engaging and forcing said plunger along said axis.

8. The banding apparatus of claim 3 wherein said transport means includes a pair of spaced apart sprockets mounted for rotation about generally horizontal axes, an endless chain mounted on said sprockets and carrying said gripping means from said position for receiving a band from said source and to said position of encircling an article with said band.

9. The banding apparatus of claim 8 wherein said gripping is fixed in its relationship with respect to said endless chain and is positioned so that said fingers extend radially outward from said endless chain.

10. The banding apparatus of claim 8 wherein said source of endless bands comprises a band dispensing means positioned above one of said sprockets and said fixed cam means is positioned adjacent said one sprocket for camming said fingers radially inwardly toward said axis to the innermost position of said fingers at said band dispenses, said fingers being substantially vertically oriented at said band dispenser for receiving a band therefrom.

11. The banding apparatus of claim 10 including band ejection means comprising a plunger extending along said central axis and having means for engaging a band on said fingers, and cam means for engaging and forcing said plunger along said axis for engaging and forcing a band off the ends of said fingers.

12. The banding apparatus of claim 11 comprising a plurality of said gripping means mounted on said endless chain, and conveyor means disposed below said endless chain for conveying articles to a position for receiving a band so that said gripping means positions a band on said articles on said conveyor when said fingers are oriented in a generally vertically downward direction.

* * * * *